US009315202B2

(12) United States Patent
Rohwerder

(10) Patent No.: US 9,315,202 B2
(45) Date of Patent: Apr. 19, 2016

(54) RAIL VEHICLE WITH AIR-CONDITIONING DUCT IN THE ROOF REGION AND METHOD FOR CONSTRUCTING A ROOF REGION OF A RAIL VEHICLE

(71) Applicant: SIEMENS AKTIENGESELLSCHAFT, Munich (DE)

(72) Inventor: Dirk Rohwerder, Sprockhoevel (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 14/387,245

(22) PCT Filed: Mar. 5, 2013

(86) PCT No.: PCT/EP2013/054356

§ 371 (c)(1),
(2) Date: Sep. 23, 2014

(87) PCT Pub. No.: WO2013/139587

PCT Pub. Date: Sep. 26, 2013

(65) Prior Publication Data

US 2015/0082712 A1 Mar. 26, 2015

(30) Foreign Application Priority Data

Mar. 23, 2012 (DE) ..... 10 2012 204 687

(51) Int. Cl.
*B61D 17/12* (2006.01)

(52) U.S. Cl.
CPC ..... *B61D 17/12* (2013.01)

(58) Field of Classification Search
CPC ..... B61D 17/12; B61D 17/18; B61D 27/00; B61D 27/0018; B61D 17/00; B61D 1/00; B61C 5/02; E04B 1/7612; E04B 7/026
USPC ..... 52/45
See application file for complete search history.

(56) References Cited

U.S. PATENT DOCUMENTS

| | | | | | |
|---|---|---|---|---|---|
| 2,193,835 | A | * | 3/1940 | Murphy et al. | 165/202 |
| 2,496,751 | A | * | 2/1950 | Ritter | 62/302 |
| 2,698,569 | A | * | 1/1955 | Reynolds et al. | 454/105 |
| 3,001,805 | A | * | 9/1961 | Jones et al. | 285/397 |
| 3,352,224 | A | * | 11/1967 | Gillick | 454/105 |
| 3,434,300 | A | * | 3/1969 | Rueth et al. | 62/309 |
| 4,062,273 | A | * | 12/1977 | O'Connor | 454/105 |

(Continued)

FOREIGN PATENT DOCUMENTS

| | | | |
|---|---|---|---|
| DE | 2145744 | A1 | 7/1973 |
| DE | 20016392 | U1 | 6/2001 |

(Continued)

*Primary Examiner* — Brian Glessner
*Assistant Examiner* — Gisele Ford
(74) *Attorney, Agent, or Firm* — Laurence Greenberg; Werner Stemer; Ralph Locher

(57) ABSTRACT

A rail vehicle has a roof region. In a longitudinal direction of the roof region, an air-conditioning duct is laid and which is bounded with respect to a passenger compartment by an inner ceiling. When the air-conditioning duct is composed in its longitudinal direction of at least two air-conditioning duct elements, the two air-conditioning duct elements are connected to one another by a sealing frame which can be prepositioned. Furthermore, a method for constructing the roof region for such a rail vehicle is specified.

9 Claims, 2 Drawing Sheets

(56) References Cited

U.S. PATENT DOCUMENTS

| | | | | |
|---|---|---|---|---|
| 4,288,115 | A * | 9/1981 | Sullivan | 285/363 |
| 4,905,478 | A * | 3/1990 | Matsuda et al. | 62/244 |
| 5,005,372 | A * | 4/1991 | King | 62/244 |
| 7,104,104 | B1 * | 9/2006 | Hermanson | 72/370.26 |
| 2003/0222981 | A1 * | 12/2003 | Kisak et al. | 348/148 |
| 2009/0042503 | A1 * | 2/2009 | Tani et al. | 454/156 |
| 2009/0130967 | A1 * | 5/2009 | Hofler et al. | 454/83 |
| 2009/0203305 | A1 * | 8/2009 | Abro | 454/152 |
| 2010/0112928 | A1 * | 5/2010 | Iantorno | 454/271 |
| 2010/0242513 | A1 * | 9/2010 | Nishino et al. | 62/244 |
| 2011/0028078 | A1 * | 2/2011 | Cermak et al. | 454/152 |
| 2012/0102846 | A1 | 5/2012 | Assel | |
| 2013/0319282 | A1 * | 12/2013 | Mitani et al. | 105/397 |

FOREIGN PATENT DOCUMENTS

| | | | |
|---|---|---|---|
| DE | 102009031599 | A1 | 1/2011 |
| EP | 2042796 | A1 | 4/2009 |
| EP | 2335954 | A1 | 6/2011 |
| GB | 2441153 | A | 2/2008 |
| JP | 2002037061 | A | 2/2002 |

* cited by examiner

RAIL VEHICLE WITH AIR-CONDITIONING DUCT IN THE ROOF REGION AND METHOD FOR CONSTRUCTING A ROOF REGION OF A RAIL VEHICLE

BACKGROUND OF THE INVENTION

Field of the Invention

The invention relates to a rail vehicle having a roof region, in the longitudinal direction of which an air-conditioning duct is placed and which is delimited with respect to a passenger compartment by means of an inner roof, and a method for constructing such a roof region.

It is known when constructing a roof region of a rail vehicle to first assemble air-conditioning duct elements, which are subsequently connected to each other in a sealing manner. After the assembly of the air-conditioning duct elements is complete, the inner roof is fitted to the air-conditioning duct elements. Examples of roof regions of a rail vehicle which are constructed in such a manner are evident from the RENFE series 103 (Velaro E) and CRH3C (Velaro CN).

In this method for constructing the roof region, it may be the case that individual air-conditioning duct elements are angled with respect to each other so that considerable complexity is involved in providing sealing connections between the individual air-conditioning duct elements.

BRIEF SUMMARY OF THE INVENTION

Based on this, an object of the invention is to provide a rail vehicle having a roof region and a method for constructing the roof region, in which the assembly of the air-conditioning duct elements and the inner roof is less complex.

This object is achieved with respect to the rail vehicle in that the air-conditioning duct is composed in the longitudinal direction thereof of at least two air-conditioning duct elements which are connected to each other by means of a sealing frame which can be pre-positioned.

As a result of the ability to pre-position the sealing frame, it is possible when the air-conditioning duct is assembled, for the sealing frame to already approximately assume the position which is required for a tight connection to an adjacent air-conditioning duct element. When the adjacent air-conditioning duct element is assembled, there is a suitable orientation/centering of the sealing frame for a tight connection so that, with respect to the prior art, extensive adjustment operations can be dispensed with.

The sealing frame can be provided at both sides with seals which are arranged so as to be adapted to end-side sealing faces of the air-conditioning duct elements. In this instance, the sealing frame carries the required seals for connecting to sealing faces of the adjacent air-conditioning duct element. Alternatively, it is also possible to provide the end-side sealing faces of the air-conditioning duct elements with seals whilst the sealing frame is in the form of a simple metal frame.

The sealing frame can be held in its position exclusively by means of the two air-conditioning duct elements. This relates in particular to the final assembled position of the sealing frame. Devices which are used in order to pre-position the sealing frame are limited in terms of their function to ensuring only the pre-positioning mentioned.

The sealing frame is preferably clamped between two air-conditioning duct elements.

The sealing frame may have flaps for pre-fixing and pre-positioning the sealing frame to/with respect to one of the air-conditioning duct elements, whilst this air-conditioning duct element then has pre-fixing bolts for engagement in the flaps on the sealing frame. In this manner, a pre-fixing and pre-positioning of the sealing frame for subsequent attachment of another air-conditioning duct element can be achieved in a simple manner.

The two air-conditioning duct elements can each form with an inner roof panel a pre-assembled assembly module which can be connected to a similar assembly module. That is to say, an extent of the inner roof panel at least substantially corresponds to the extent of an individual air-conditioning duct element in the longitudinal direction of the rail vehicle so that, in the longitudinal direction of the rail vehicle, by means of continuous assembly of the assembly modules comprising the inner roof panel and air-conditioning duct element, the complete air-conditioning duct and also the complete inner roof of the rail vehicle is produced.

The inner roof panel may be releasably assembled on the air-conditioning duct element. When the assembly module is already installed, this allows positional changes which are still required to be able to be carried out with respect to the air-conditioning duct elements, in particular with respect to a discharge of air-conditioned air.

The sealing frame may have a gap cover at the side thereof facing the vehicle inner space, the gap cover being adapted to an outer shape of the inner roof panel and being arranged in order to cover a gap between two inner roof panels which adjoin each other in the longitudinal direction of the roof region. In this manner, the gap cover enables a favorable optical impression of the inner roof which is composed of the plurality of inner roof panels since, in the case of two adjacent assembly modules, it covers the gap present between two mutually adjacent inner roof panels in a reliable manner.

The gap cover of the sealing frame may additionally be provided with a fire detector.

The problem addressed is solved with respect to the method for constructing a roof region of a rail vehicle by a method having the sequential steps of:

a) pre-fixing an assembly module comprising an air-conditioning duct element and an inner roof panel to a roof of the vehicle,
b) assembling the assembly module,
c) pre-fixing a sealing frame to the assembly module,
d) pre-fixing another similar assembly module at a free side of the sealing frame and
e) assembling the additional assembly module by clamping the sealing frame between the two assembly modules.

BRIEF DESCRIPTION OF THE SEVERAL VIEWS OF THE DRAWINGS

An embodiment of the invention is explained in greater detail below with reference to the drawings, in which.

DESCRIPTION OF THE INVENTION

Figure 1:
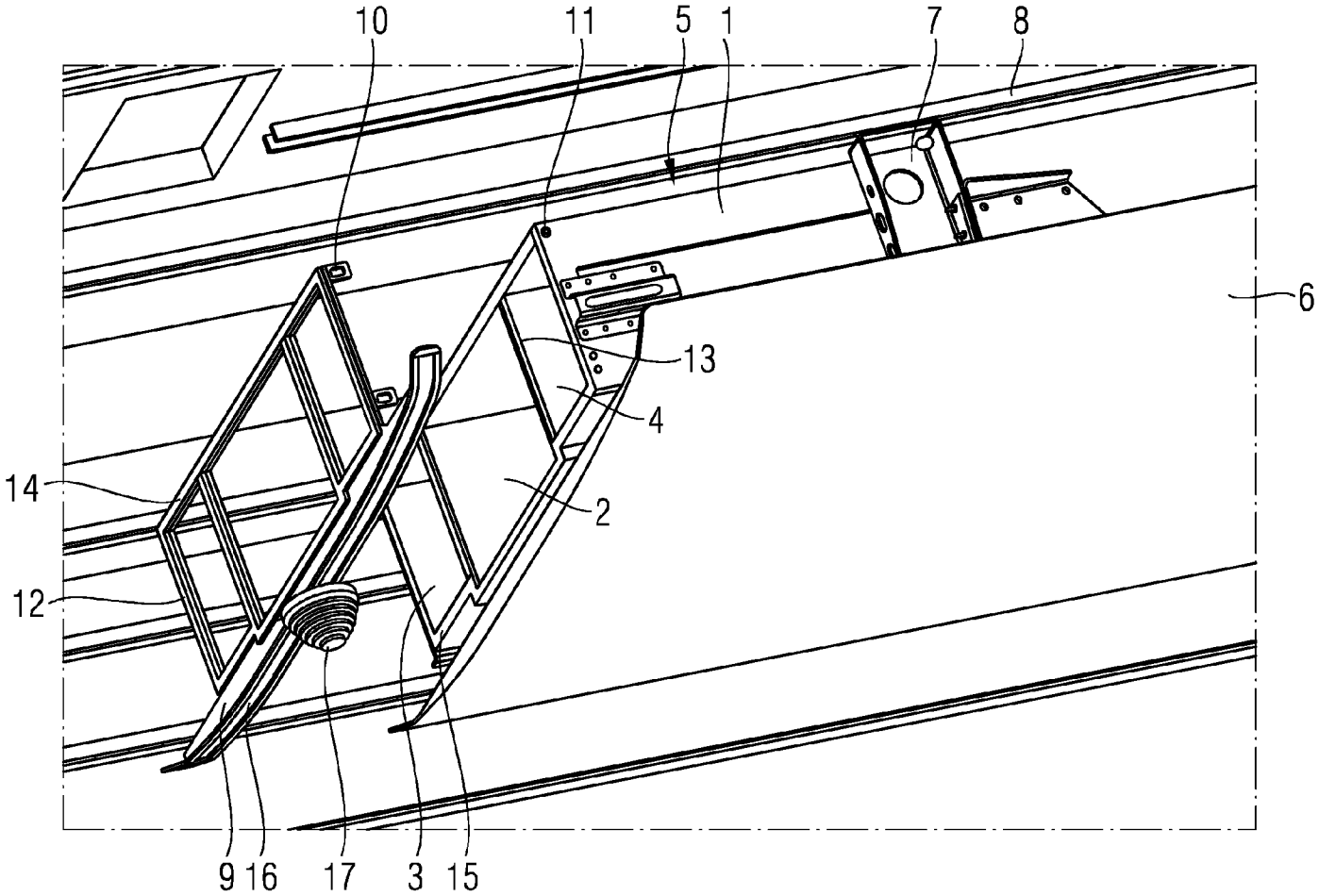
FIG. 1 is a perspective view of a roof region of a rail vehicle with an air-conditioning duct and inner roof mounted therein.

FIG. 1 shows a roof region portion of a rail vehicle. In this instance, an air-conditioning duct element 1, comprising a main duct 2 and two auxiliary ducts 3, 4, forms a pre-assembled assembly unit 6 with an inner roof panel 5. The assembly unit 6 has vertically orientated retention members 7, which serve to pre-fix the assembly unit 6, which is ultimately intended to be fitted to a C-rail 8.

The inner roof panel 5 corresponds in terms of the length thereof substantially to the length of the air-conditioning duct element 1 and is adapted in terms of the width thereof to the requirements in the rail vehicle. The inner roof panel 5 further delimits the roof region of the rail vehicle from a passenger compartment.

The air-conditioning duct element 1 forms with additional air-conditioning duct elements (not illustrated) an air-conditioning duct which extends at the inner side of the roof over an entire length of the rail vehicle. In this instance, two air-conditioning duct elements 1 which are mutually adjacent in the longitudinal direction of the roof region are always connected to each other by means of a sealing frame 9.

The sealing frame 9 has a total of four horizontally orientated pre-fixing flaps 10 which are each fitted to the sealing frame 9 in pairs laterally and at the top or at the bottom. In this instance, a spacing of the flap pairs 10 in the transverse direction of the roof region corresponds to the extent of the air-conditioning duct element 1 in the same direction in such a manner that the flaps 10 can cooperate with pre-fixing bolts 11 at the outer side on the air-conditioning duct element 1 in order to pre-fix the sealing frame 9. Using the flaps 10 and the pre-fixing bolts 11, the sealing frame 9 can be fitted to the air-conditioning duct element 1 in a non-fixed manner but, for example, so as to be still movable in the longitudinal direction of the roof region. Consequently, the sealing frame 9 is pre-positioned in an appropriate manner for it to be able to be secured by means of assembly of an air-conditioning duct element (not shown) which is adjacent to the left in FIG. 1. This securing is based on the fact that the sealing frame 9 is clamped between the air-conditioning duct element 1 and the additional, similar air-conditioning duct element, without additional securing of the sealing frame 9 being required.

Figure 2:
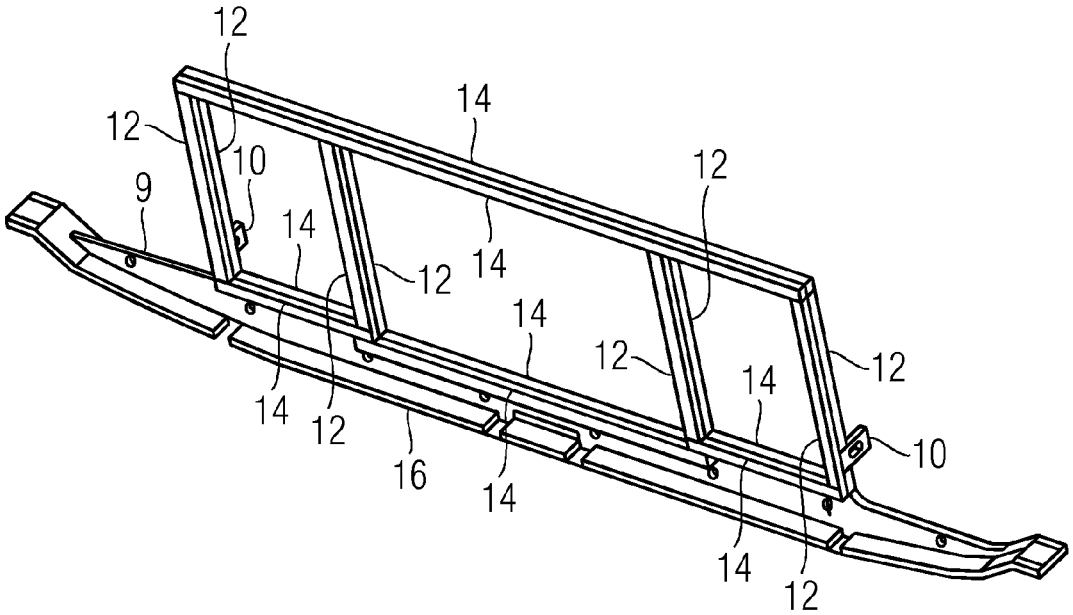
FIG. 2 is a perspective view of a sealing frame for use in the roof region of FIG. 1.

The construction of the sealing frame 9 (without the upper flaps 10 in FIG. 1) can be seen in greater detail in FIG. 2. The sealing frame 9 has at each of the two sides four vertically extending, strip-like seals 12, whose position is adapted to the position of the associated sealing faces 13 at an end side of the air-conditioning duct element 1. Furthermore, the sealing frame 9 has at each of the two sides three horizontally extending, strip-like seals 14 which are associated with horizontal sealing faces 15 at the end side of the air-conditioning duct element 1.

At the lower side thereof, the sealing frame 9 carries a gap cover 16 whose outer shape is adapted to the shape of the inner roof panel 5. This occurs in such a manner that a gap which is produced between the inner roof panel 5 and another inner roof panel which is adjacent to the left in FIG. 1 is closed in a reliable manner by means of the gap cover 16 of the sealing frame 9.

In addition, the sealing frame 9 is provided at the lower side of the gap cover 16 with a fire detector 17.

The invention claimed is:

1. A rail vehicle, comprising:

a roof region having a plurality of inner roof panels;

a passenger compartment;

an air-conditioning duct disposed in a longitudinal direction of said roof region, said air-conditioning duct delimited with respect to said passenger compartment by means of said inner roof panels, said air-conditioning duct containing:

at least two air-conditioning duct elements disposed in the longitudinal direction; and a sealing frame connecting said at least two air-conditioning duct elements to each other coaxially in the longitudinal direction, each of said air-conditioning duct elements connected to an opposite side of said sealing frame, said sealing frame having a side and a gap cover at said side thereof facing an vehicle inner space, said gap cover adapted to an outer shape of said inner roof panels and disposed to cover a gap between two of said inner roof panels adjoining each other in the longitudinal direction of said roof region by said gap cover overlapping adjoining roof panels.

2. The rail vehicle according to claim 1, wherein:

said air-conditioning duct elements each have end-side sealing faces; and said sealing frame has sides and seals disposed at said sides, said seals adapted in form to said end-side sealing faces of said air-conditioning duct elements.

3. The rail vehicle according to claim 1, wherein said sealing frame is directly connected between said two air-conditioning duct elements.

4. The rail vehicle according to claim 3, wherein said sealing frame is clamped between said two air-conditioning duct elements.

5. The rail vehicle according to claim 1, wherein said sealing frame has flaps for fixing said sealing frame to one of said air-conditioning duct elements, and said air-conditioning duct elements have bolts for engagement in said flaps.

6. The rail vehicle according to claim 1, wherein said two air-conditioning duct elements each form with said inner roof panel a pre-assembled assembly module which can be connected to another said pre-assembled assembly module.

7. The rail vehicle according to claim 6, wherein said inner roof panel is releasably assembled on said air-conditioning duct elements.

8. The rail vehicle according to claim 1, wherein said sealing frame has a fire detector, said fire detector disposed on said gap cover.

9. A method for constructing a roof region of a rail vehicle, which comprises the steps of:

assembling a first assembly module containing an air-conditioning duct element and inner roof panels;

fixing the first assembly module to a roof of the rail vehicle;

fixing a sealing frame to the first assembly module in an adjustable manner where the sealing frame can move in a longitudinal direction;

fixing a second assembly module at a free side of the sealing frame;

adjusting the sealing frame in the longitudinal direction between the first and second assembly module, the sealing frame having a side and a gap cover at the side thereof facing an vehicle inner space, the gap cover adapted to an outer shape of the inner roof panels and disposed to cover a gap between two of the inner roof panels adjoining each other in the longitudinal direction of the roof region by the gap cover overlapping adjoining roof panels; and clamping the sealing frame between the first assembly module and the second assembly module.

* * * * *